US005632878A

United States Patent [19]

Kitano

[11] Patent Number: 5,632,878

[45] Date of Patent: May 27, 1997

[54] METHOD FOR MANUFACTURING AN ELECTROFORMING MOLD

[75] Inventor: Minoru Kitano, Nagoga, Japan

[73] Assignee: FET Engineering, Inc., Bardstown, Ky.

[21] Appl. No.: 547,677

[22] Filed: Oct. 17, 1995

Related U.S. Application Data

[63] Continuation of Ser. No. 249,018, May 26, 1994, abandoned.

[30] Foreign Application Priority Data

Feb. 1, 1994 [JP] Japan ..... 6-010585

[51] Int. Cl.[6] ..... C25D 1/10

[52] U.S. Cl. ..... 205/70; 205/75; 205/112; 205/273

[58] Field of Search ..... 205/67, 70, 75, 205/112, 273

[56] References Cited

U.S. PATENT DOCUMENTS

| | | | |
|---|---|---|---|
| 3,264,200 | 8/1966 | Clauss | 205/273 |
| 3,853,714 | 12/1974 | Shimada | 205/73 |
| 4,054,495 | 10/1977 | Law | 205/275 |
| 4,488,942 | 12/1984 | Martin | 205/245 |
| 4,714,424 | 12/1987 | Kinugasa | 425/388 |
| 4,913,783 | 4/1990 | Piolat | 205/75 |
| 5,024,733 | 6/1991 | Abys | 205/257 |
| 5,024,900 | 6/1991 | Kuruma | 428/626 |

OTHER PUBLICATIONS

Lowenheim, F., *Electroplating,* McGraw Hill, (1978), (pp. 150–152).

*Primary Examiner*—John Niebling
*Assistant Examiner*—Brendan Mee
*Attorney, Agent, or Firm*—Banner & Witcoff, Ltd.

[57] ABSTRACT

An electroformed tool that has a uniform air-releasing hole system with high strength and a simple and convenient method to manufacture it has been created. The method includes conducting electroforming by mixing a non-leveling agent with an electrolytic solution and forming an electroformed layer which has a continuous air-releasing hole structure.

5 Claims, 1 Drawing Sheet

METHOD FOR MANUFACTURING AN ELECTROFORMING MOLD

This application is a continuation of application Ser. No. 08/249,018 filed May 26, 1994, now abandoned.

BACKGROUND OF THE INVENTION

This invention relates to a method of manufacturing an electroformed tool, especially, a method of manufacturing an electroformed tool suitable as a mold to form plastic.

PRIOR ART

Conventionally, tools for plastic blow-molding or vacuum forming, etc. have numerous minute holes to release gas coming out of a parison which is forming material or a heated sheet or air in the tools.

Concerning methods to make the holes, available are methods such as a mechanical one to make holes by a minute drill, etc. after making a tool, or an electric-chemical method to make a tool by means of electroforming, etc., that is able to form a porous electrodeposited layer in order to have a tool itself made of a porous substance, and so forth.

However, the former method is not very preferable because it is too costly and requires too much time due to the very troublesome work to make many minute holes. On the other hand, the latter method is better in terms of cost and time because a tool becomes porous in its manufacturing process. But, due to the features of its manufacturing process, the process has defects such that the formation and shape of the holes are uncertain, that the walls around the holes tend to be thin or that strength enough for a tool cannot be obtained because material containing fine bubbles tends to be deposited and by other reasons.

Further, even if it bears usage as a tool, there is another problem that it is very difficult to repair if damaged during use.

In the Japanese laid open patent specification HEI5-156486, a method of manufacturing an electroformed tool with many air-releasing holes formed by an electroforming method is disclosed. In this method, a mother tool on which holes are created in advance is used as a cathode or a negative pole and electroforming operation is done by electroforming solution substantially without a surface-active agent. The idea is to make it easy to keep hydrogen gas coming out at the time of electrodeposition in a non electrically-conducting part made by piercing holes in a mother tool in advance and, by doing so, to let holes grow as holes, without adding a surface-active agent, such as sodium laurylsulfate which conventionally has been added to suppress pin hole growth.

However, it is important there be uniformity of thickness to manufacture an electroformed tool. Because of this, in a proper time during the manufacturing process, a tool is taken out of the electroforming solution and the thickness of the electrodeposited part is measured. After masking the part that has already reached the predetermined thickness, the tool is put into the electroforming solution again and the electroforming operation is repeated. This kind of operation is usually repeated five times. The number of times increases or decreases, depending on a shape of the tool.

However, in the case where electrodeposition is resumed by putting a tool into the electroforming solution after masking the work, holes have indeed hollow parts and are formed as holes by electrodeposition at the early stage of this electrodeposition. But, because the hollow parts are not non electrically-conducting parts when electrodeposition is resumed due to non-existence of hydrogen gas collection, and the holes slowly become smaller by the leveling function of the electroforming solution. In this way, repetition of masking the work tends to cause the phenomenon that the holes finally disappear. Therefore, problems are inevitable in this method, as they are in the method to make holes in the electroformed tools by a drill, etc.

Further, this electrodeposition method does not solve the problem, in that it tends to be a vulnerable deposited material containing minute bubbles of hydrogen gas by the leveling function of the electroforming solution because the method is to maintain and grow the holes made on the mother tool in advance, by means of hydrogen gas coming out in the process of electrodeposition.

THE PROBLEMS THAT THE INVENTION IS GOING TO SOLVE

Therefore, the purpose of this invention is to provide an easy and convenient method of manufacturing a porous tool by a new electroforming method free from the problems that are found in a porous tool manufactured by a conventional electroforming method, such as lack of strength and non-uniformity of air-releasing hole systems and shapes.

MEANS TO SOLVE THE PROBLEMS

The inventors discovered that what is called a pit (non-electrodeposited part) could be very easily formed and certainly grown by adding a non-leveling agent to the electroforming solution in the process of electroforming on the electrically-conducting part formed on the insulating base formed in the shape of prototype, and created this invention.

Namely, this invention, in the broadest sense, pertains to a method of manufacturing an electroformed tool in which the metal electrodeposited layer is formed by depositing metal on the base by electroforming, characterized by using electroforming solution to which is added a non-leveling agent during the process of depositing metal on the base.

Furthermore, to be more specific, this invention pertains to a method of manufacturing an electroformed tool having an electrodeposited metal layer with a non-electrodeposited portion by preparing an electrically-conducting base or a non-electrically-conducting base, in which, in case of the non-electrically-conducting base, an electrically-conducting layer is provided on the surface of the base and then metal is deposited on said base by electroforming, using electroforming solution to which is added a non-leveling agent.

Here, since "non-leveling agent" has a function to reduce horizontal growth of plating electrodeposition and positively grow electrodeposition in a vertical direction in the sense of thickness by working on the leveling ability of the electrolytic plating solution, it functions to grow non-electrodeposited parts created by various factors at the early stage of electrodeposition (the cause of pit growth) as holes during electrodeposition, without plugging them.

By the way, the "surface-active agent" functions, by absorbing molecules of a solid body or liquid to enhance permeability or water affinity of the object to be electrodeposited and the electrolytic plating solution, and to make it easier for the electrolytic solution to get into minute portions of the electrodeposited surface. Concurrently, it functions to promote removal of the air film attached to the surface of the object to be electrodeposited at the early stage of electrodeposition or hydrogen gas attached to the electrodeposited surface created by the electrolytic reaction.

Further, in this invention, the physical property or mechanical strength of electrodeposited metal can be improved, since minute bubbles of hydrogen gas can be kept from remaining in the electrodeposited metal layer, by using a proper amount of surface-active agent as well and promoting removal of hydrogen gas created in the process of electrodeposition apart from the electrodeposited surface.

DETAILED DESCRIPTION OF THE INVENTION

Figure 1:
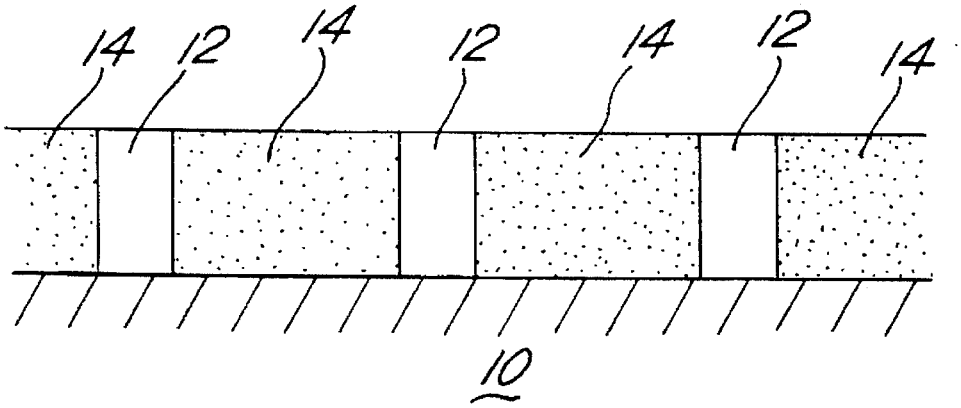
FIG. 1 is a view showing the manner of growth of an electrodeposited layer and pits (non-electrodeposited layer) when electroforming is done by electroforming solution to which was added a non-leveling agent, according to this invention.

The effect of the invention is specifically explained below.

In order to work the manufacturing method related to this invention, first, a base which is formed in a shape of a prototype is prepared. The material constituting this base may be either electrically-conducting or non-electrically-conducting and it is not particularly limited. As stated below, since the base will be removed from the electroformed body, inexpensive material, for example, plastic material to be easily formed in a predetermined shape, such as epoxy resin, polyester resin, phenol resin, urea resin, etc. is preferable, unless it is to be reused.

Therefore, this base is formed of, for example, epoxy resin, etc. in the predetermined surface shape of, for example, an automotive door trim, etc. by utilizing the reverse tool, etc. of the product model.

Next, the invention is more specifically explained by taking as an example the case when epoxy resin, which has a non-electrically-conducting property, is used as the material to constitute the base.

Since epoxy resin naturally has insulating properties, it forms a continuous film of an electrically-conducting layer by utilizing a silver mirror reaction, which is a sort of silver chemical plating on the surface to be covered or by painting electrically-conducting painting material such as silver lacquer, etc. Further, when silver mirror reaction is used on an electrically-conducting layer, it is preferable to do an oil-removing treatment on the surface of the base to be covered prior to formation of this electrically-conducting layer in order to enhance adhesive power of the electrically-conducting layer to the base, and to enhance sensitivity by painting stannous chloride solution, and so forth.

The base provided with an electrically-conducting layer on its surface is inserted into an electroforming tank filled with electrolytic plating solution constituting a predetermined composition including non-leveling agent, and the electrically-conducting layer of said base becomes a cathode or a negative pole, while the other pole which is a positive pole is constituted by things such as a metal plate made of the same metal as the one to be electrodeposited, and the electroforming is conducted by adding the predetermined voltage between both poles.

Usually, in order to prevent pits, an oxidated film on the surface of the electrically-conducting layer is chemically removed and activated, and further, prior treatment such as adding water affinity by pouring water solution of surface-active agent is provided before insertion into the electroforming tank. In this invention, it is preferable to insert with the dried electrically-conducting layer surface into an electroforming tank, without conducting the prior treatment in order to positively create pits.

In addition, formation of pits is caused by the extent of a sort of insulating destruction phenomenon at the time of electrodeposition to the oxidated film by air oxidation formed on the surface of said electrically-conducting layer formed as explained above, the extent of removal of the air film attached to the surface of the electrically-conducting layer at the time of soaking into the tank, or non-successive parts such as partial subtle hollows existing on the surface and so forth. This is also promoted by the attachment of hydrogen gas, which is created by the gaps of hydrogen overvoltage between electrically-conducting layer metal and electrodeposited metal, or the attachment of dust in the electrolytic solution (minute foreign substance) and so forth. Certainly, a base can have many minute holes on it by a mechanical means such as using a drill, etc.

Further, in order to form pits more easily (non-electrically-conducting parts), hydrophobic non-electrically-conducting particles such as polytetrafluroethylene (PTFE), etc. may be sprayed or combined with the resin in advance.

In case of using an electrically-conducting base, it is not necessary to provide another non-electrically-conducting layer, as far as only electrically-conductive as a cathode or a negative pole is considered. An electroformed tool is used with its electrodeposited metal part separate from the base. Thus, considering convenience of separation, it is preferable to provide an electrically-conducting layer surface such as silver mirror reaction, as in the case of non-electrically-conducting base.

Electroforming operations themselves can be conventional ones as well as the composition of electrolytic plating solution, except for using non-leveling agent. The electroforming operations are not limited at all.

As an electroforming process progresses, formed non-electrodeposited parts (pits) grow by existence of minute remaining parts of oxidated film on the base surface or minute hollows on the base surface and are stably reserved and grow in accordance with the growth of the electrodeposited metal layer by adsorbing effect of the non-leveling agent.

Specific kinds of non-leveling agents used in this invention are explained as below.

The non-leveling agent used in this invention functions to control activation against diffusing control by the leveling agent at the time of electrodeposition. The composition of the non-leveling agent comprises a proper amount of benzenesulfonic acid or its derivatives, carboxylic acid or its salt such as formic acid or hemimellitic acid, nicotinic acid or its derivatives such as nicotinamid, methyl-pentynol and its derivatives, etc. Preferable non-leveling agents are benzenesulfonic acid, carboxylic acid, nicotinic acid and methyl-pentynol. Due to activation control, because electrodeposited metal crystallization and growth progress in the vertical direction of the base and rarely progress in the horizontal direction, non-electrodeposited parts remain as they are.

Namely, as illustrated in FIG. 1, by this invention, pits 12 formed on the base 10 at the initiation of electroforming are, by the function of the non-leveling agent, reserved stably and continue to grow in accordance with the formation of the electrodeposited metal layer 14. FIG. 1 shows how the pits 12 on the surface of a cathode or a negative pole grow.

In this way, when a non-leveling agent is combined with electrolytic solution by this invention, since electrodeposition has activation control by its function, plating is continued with the shape of the original plated surface as it is, that is, with plating metal not diffused on the pits, and the bottoms of minute hollows which is hard to reach by current are difficult to be plated, and this tendency is intensified as the thickness of the plate increases. Despite the growth of the plating layer, non-electrodeposited parts remain as they are.

In the preliminary examination to eliminate leveling property of plating electrolytic solution done by the inventors, by adding benzenesulfonic acid or carboxylic acid as a non-leveling agent to the nickel electrolytic solution of the standard composition, within the range of 0.05–0.8 g/L additive amount, uniform electrodeposition was made available without at all losing grinded surface on a brass plate made by No. 800 sand paper.

Further, when nicotinic acid derivative or methylpentynol and its derivatives and so forth are used, the same result was obtained within the range of 0.001–0.1 g/L additive amount.

In the preliminary examination to obtain a porous electroformed body, by the effect of non-leveling agent, non-plated parts created by hydrogen gas which was created and attached to the silver mirror surface at the early stage of electrodeposition remained as they were and other plated parts grew and non-plated parts remained as pits and a porous electroformed body was obtained. In this condition, electroforming was carried out for several days and a porous electroformed tool is formed. Since an electroformed tool manufactured in the above manner has enough air permeability, it may be used for plastic tooling. In order to improve strength, a back-up layer can be provided for supplemental strength.

According to the preferable embodiment of this invention, aqueous colloid solution of hydrophobic non-electrically-conducting particles, for example, fine particles of plastic, such as PTFE, etc. by using a surface-active agent, can be mixed into an electrolytic solution tank.

Fine particles, such as PTFE, added in the electrolytic solution are diffused into the liquid by effect of a surface-active agent and the stirring of the electrolytic solution, and a part of them attach to the electrodeposited surface of the base. Since the diffusion and dispersion of the fine particles are done uniformly, attachment to the electrodeposited surface of the base is done almost entirely uniformly. Therefore, by adjusting the amount of the fine particles to be mixed, attachment density to the electrodeposited surface can be adjusted.

In this way, in the case of the above embodiment, since fine particles existing in the condition that they are attached to the electrodeposited surface, namely, the first electrodeposited metal layer are insulators, metal ions are not electrodeposited to the part and the part starts becoming the hollow part of the electrodeposition. When fine particles further attached are insulators and concurrently hydrophobic, hydrogen gas inevitably created at the time of electrodeposition tends to attach to the part, and, as a result, it starts growing as a larger pit than that on the porous electrodeposited metal layer in the lower layer.

Figure 2:
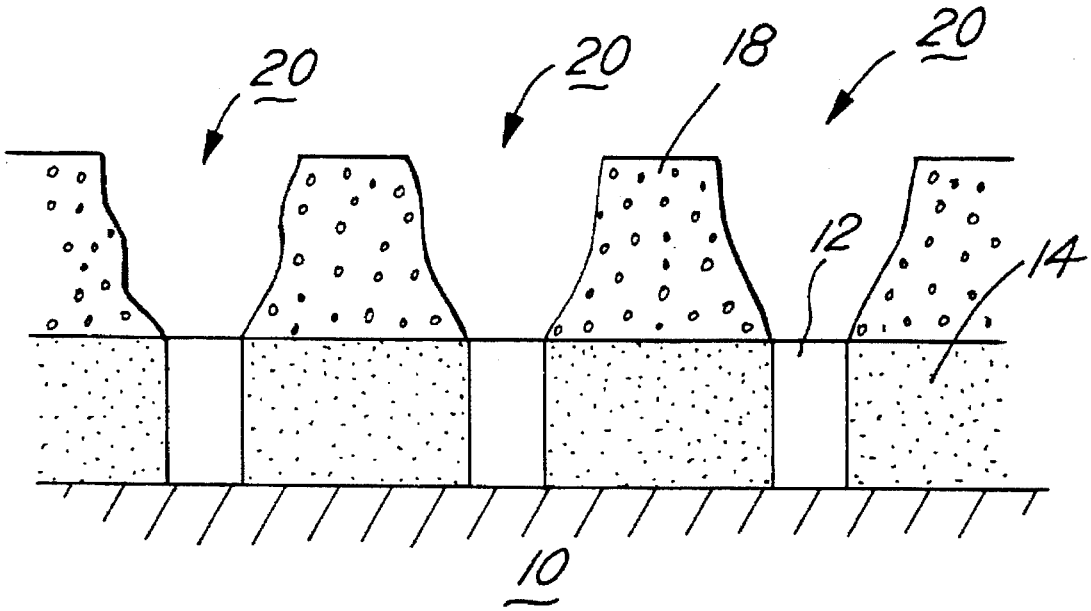
FIG. 2 is a view similar to FIG. 1 showing a preferred embodiment of the invention.

FIG. 2 shows the constitution of the electrodeposited metal layer at this time. Pits 12 grown as illustrated in FIG. 1, grow bigger and form enlarged pits 20, forming the second electrodeposited metal layer 18 on the first electrodeposited metal layer 14.

Since non-electrically-conducting particles, such as fine particles of PTFE used in the above embodiment, are, as described above, diffused uniformly into the electrolytic solution, they attach to the entire electrodeposited surface of the base and pits are created in each part and from the entire view, the second electrodeposited metal layer having a uniform continuous air permeable structure is formed during the ordinary electrodepositing process, which is desirable.

The thickness of the second electrodeposited metal layer which is electrodeposited in the above manner is not particularly limited, but generally, about ⅔ to ¾ of the entire thickness seems to be sufficient.

In this way, in an electroformed tool manufactured according to this invention, the manufactured surface of an outer surface which is an electrodeposited metal layer is a porous electroformed layer by the promoting effect of the non-leveling agent. This porous electroformed layer is something on which numerous, what is called plated pits occurred, and parts other than the pits are the ordinary plating film and the manufactured surface has enough strength. In the case where said second electrodeposited metal layer is further formed, depending on necessity, a predetermined porous tool which can be used as it is obtained, since a two-layered porous electrodeposited layer is formed during the process.

EMBODIMENT

Next, embodiments of this invention are enumerated. It should be understood that these are shown as mere examples of this invention and this invention is not limited by the embodiments.

EMBODIMENT 1

A base having a surface shape of an automotive door trim was made of epoxy resin by using a reverse tool. On the base, by an ordinary silver mirror reaction, an electrically-conducting layer comprising a silver film is formed and then is put into an electroforming tank.

The base prepared in this way was made a cathode or a negative pole. On the other hand, a nickel tip in a metal titan basket case was used as a positive pole and electrodeposition was conducted in an electroforming tank filled with electrolytic plating solution comprising the composition shown in Table 1.

The electrodepositing condition is shown in Table 1. Further, in this embodiment, the above non-leveling agent was used.

TABLE 1

| Electrolytic solution to form the first layer | |
|---|---|
| nickel sulfamate | 300–400 g/L |
| nickel chloride | 5–10 g/L |
| boric acid | 30–40 g/L |
| surface-active agent | proper amount |
| non-leveling agent (benzenesulfonic acid) | 0.1–0.5 g/L |
| Electrodepositing condition | |
| pH | 3–4 |
| Temperature | 40–50° C. |
| Current density | 0.5 A/dm$^2$ |
| Term | 4 days |

The manufactured electroformed tool was an electroformed body with 0.3–0.5 mm thickness and about 70 pits (holes) of 10–20 μm in 1 dm$^2$.

EMBODIMENT 2

After finishing electroforming of embodiment 1, 0.02–0.05 g/L of PTFE particles with a diameter 5 μm was further added to the below second electrolytic solution and the electrodeposition operation was continued for 2 days. The obtained two-layer structure electroformed body had sufficient air permeability.

| Electrolytic solution to form the second layer | |
|---|---|
| nickel sulfamate | 300–400 g/L |
| nickel chloride | 5–10 g/L |
| boric acid | 30–40 g/L |
| surface-active agent | proper amount |
| polytetrafluoroethylene (PTFE) | 0.02–0.05 g/L |

THE EFFECT OF THE INVENTION

As explained in detail above, an electroformed tool manufactured by this invention comprises a porous electroformed layer(s). In order to manufacture such a porous electroformed body, insulating parts to form minute holes on the electrically-conducting layer of the base are scattered in advance as in the conventional way. Non-electrodeposited parts formed by this method continue to grow as they are by adding a non-leveling agent and a predetermined strength of electrodeposited metal can be obtained, and, without plugging minute holes, the mechanical strength as an electroformed tool is enhanced.

What is claimed is:

1. A method of manufacturing a porous electroformed tool in which a metal deposited layer is formed by depositing metal on a base by electroforming, characterized by using electroforming solution comprising nickel sulfamate, in the range of 300–400 g/L, nickel chloride in the range of 5–10 g/L, and boric acid in the range of 30–40 g/L, to which is added a non-leveling agent consisting of benzene sulfonic acid or a carboxylic acid or nicotinic acid or methyl-pentynol in the range of 0.05–0.8 g/L in the process of depositing metal on the base to form a porous electroformed tool having about 70 holes of 10–20 μm per $dm^2$.

2. The method of claim 1 comprising adding the non-leveling agents benzenesulfonic acid or a carboxylic acid in the range of about 0.1–0.5 g/L.

3. The method of claim 1 including the step of providing a second electrodeposited layer by using a second electroforming solution comprising nickel sulfamate, nickel chloride and boric acid to which is added polytetrafluorethylene.

4. The method of claim 3 comprising adding the polytetrafluorethylene in the range of about 0.02–0.05 g/L.

5. A method of manufacturing a porous electroformed tool in which a metal deposited layer is formed by depositing metal on a base by electroforming, characterized by using electroforming solution comprising nickel sulfamate, in the range of 300–400 g/L, nickel chloride in the range of 5–10 g/L, and boric acid in the range of 30–40 g/L, to which is added a non-leveling agent consisting of benzene sulfonic acid or a carboxylic acid or nicotinic acid or methyl-pentynol in the process of depositing metal on the base to form a porous electroformed tool having about 70 holes of 10–20 μm per $dm^2$, said nicotinic acid or methyl-pentynol being added in the range of about 0.001–0.1 g/L.

* * * * *